US006869065B1

(12) United States Patent
Lin

(10) Patent No.: US 6,869,065 B1
(45) Date of Patent: Mar. 22, 2005

(54) VAPOR CLEANER

(76) Inventor: Mow-Hwa Lin, 5F, No. 46, Chienkuo 2 Rd., Sanmin Dist., Kaohsiung (TW)

( * ) Notice: Subject to any disclaimer, the term of this patent is extended or adjusted under 35 U.S.C. 154(b) by 0 days.

(21) Appl. No.: 10/690,373

(22) Filed: Oct. 21, 2003

(51) Int. Cl.[7] ..... B01F 3/04

(52) U.S. Cl. ..... 261/3; 122/402; 122/403; 261/5; 261/72.1; 261/142; 261/DIG. 65

(58) Field of Search ..... 261/3, 5, 72.1, 261/142, DIG. 65; 122/402, 403; 15/327.2, 415.1

(56) References Cited

U.S. PATENT DOCUMENTS 4,051,205 A * 9/1977 Grant ..... 261/70
4,098,853 A * 7/1978 Brown et al. ..... 261/122.1
4,644,790 A * 2/1987 Mizoguchi ..... 73/293
4,752,422 A * 6/1988 Uchida et al. ..... 261/81
5,131,070 A * 7/1992 Chiu et al. ..... 392/405
5,291,579 A * 3/1994 Marino ..... 392/406
5,339,383 A * 8/1994 Marino ..... 392/406
5,792,390 A * 8/1998 Marino ..... 261/72.1
6,062,425 A * 5/2000 Brown et al. ..... 222/1
6,220,579 B1 * 4/2001 Chen ..... 261/131
6,275,652 B1 * 8/2001 Chauviaux ..... 392/405
6,382,142 B1 * 5/2002 Chen ..... 122/379
2003/0011086 A1 * 1/2003 Wu ..... 261/119.1

FOREIGN PATENT DOCUMENTS

JP 5-52371 * 3/1993 ..... 261/DIG. 65

* cited by examiner

*Primary Examiner*—Richard L. Chiesa
(74) *Attorney, Agent, or Firm*—Jackson Walker LLP

(57) ABSTRACT

A vapor cleaner includes a mainframe having a hole defined in a hollow body of the mainframe, a recess defined in the hollow body to receive therein a filter with an inlet in communication with the hole and an outlet in communication with a telescopic tube, a control pump sandwiched between the outlet of the filter and the telescopic tube for pumping water to the telescopic tube, a nozzle assembly detachably connected to the mainframe and having a heater received in the nozzle assembly for heating the water pumped by the control pump to flow through the heater from the telescopic tube, and a reservoir detachably connected to the mainframe via a locking device.

10 Claims, 8 Drawing Sheets

VAPOR CLEANER

BACKGROUND OF THE INVENTION

1. Field of the Invention

The present invention relates to a cleaner, and more particularly to a vapor cleaner having a reservoir detachably connected to the base of the vapor cleaner so that the operator is able to operate the vapor cleaner easily while moving the vapor cleaner around.

2. Description of Related Art

A vapor cleaner is a device having the capability to transform the liquid received in a reservoir to vapor to clean stains or to kill germs on the wall or the like under the condition of adding chemical substance to the liquid. There are normally two types of a conventional vapor cleaner, one is the integral type and the other is the separate type.

The integral type of vapor cleaner has a main frame with a reservoir to receive therein water, a pump received in the main frame to transport the water in the reservoir and a heater to transform the water into vapor. When this type of vapor cleaner is used, the operator turns on the switch to initiate the transportation of the water from the reservoir to pass the heater. The heat from the heater then transforms the water into vapor which is emitted from the nozzle.

The separate type of vapor cleaner has a casing and a nozzle connected to the casing by a telescopic tube. The casing has a reservoir, a pump and a filter. The filter has an inlet connected to the outlet of the reservoir. The pump has an inlet connected to an outlet of the filter and an outlet connected to the telescopic tube. The nozzle has a heater inside and a switch to control operation of the pump.

When the separate type of vapor cleaner is used, the operator fills the reservoir with water and turns on the heater to initiate heat. Then after the pump is activated by actuation of the switch, the water is pumped to pass the filter and the heater such that the water is transformed into vapor and the vapor is able to clean the stains or germs on the walls.

However, the integral type vapor cleaner has a major disadvantage which when water is received in the reservoir, the entire device becomes heavy. The operator will have to use a lot of effort to manipulate the device around. If the disadvantage is to be deleted, the water volume is limited, which reduces the overall effect of the vapor cleaner.

When the separate type vapor cleaner is used, due to the separate design of the casing and the nozzle, the operator is able to operate the cleaner easily. However, because the reservoir is mounted inside the casing, the operator will have to drag the casing to the water source to refill the reservoir. After the overall weight of the vapor cleaner becomes heavier and heavier due to the addition of fresh water, the operator may not be able to effortlessly move the vapor cleaner.

To overcome the shortcomings, the present invention tends to provide an improved vapor cleaner to mitigate the aforementioned problems.

SUMMARY OF THE INVENTION

The primary objective of the present preferred embodiment is to provide an improved vapor cleaner having a reservoir detachably received in the mainframe such that the operator is able to easily refill the reservoir by only refilling the reservoir without the involvement and movement of other assemblies of the vapor cleaner.

Another objective of the present invention is to provide a locking device for the detachment of the reservoir to the mainframe so as to secure the engagement of the reservoir to the mainframe.

Other objects, advantages and novel features of the invention will become more apparent from the following detailed description when taken in conjunction with the accompanying drawings.

DETAILED DESCRIPTION OF THE PREFERRED EMBODIMENT

Figure 1:
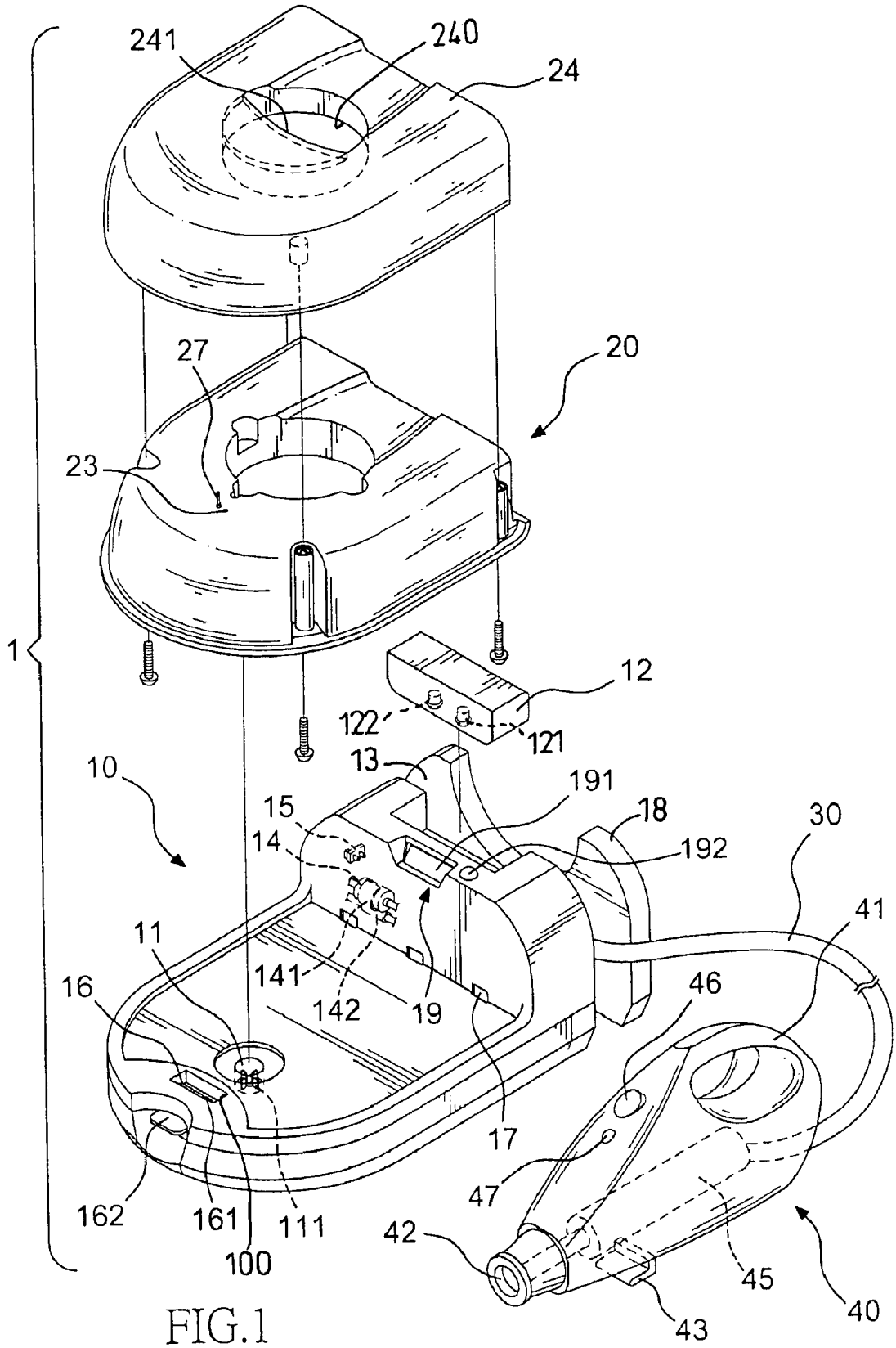
FIG. 1 is an exploded perspective view of the vapor cleaner of the present preferred embodiment.

With reference to FIG. 1, the vapor cleaner in accordance with the present preferred embodiment has a mainframe (10), a reservoir (20), and a nozzle assembly (40) in communication with the mainframe (10) by a telescopic tube (30).

Figure 3:
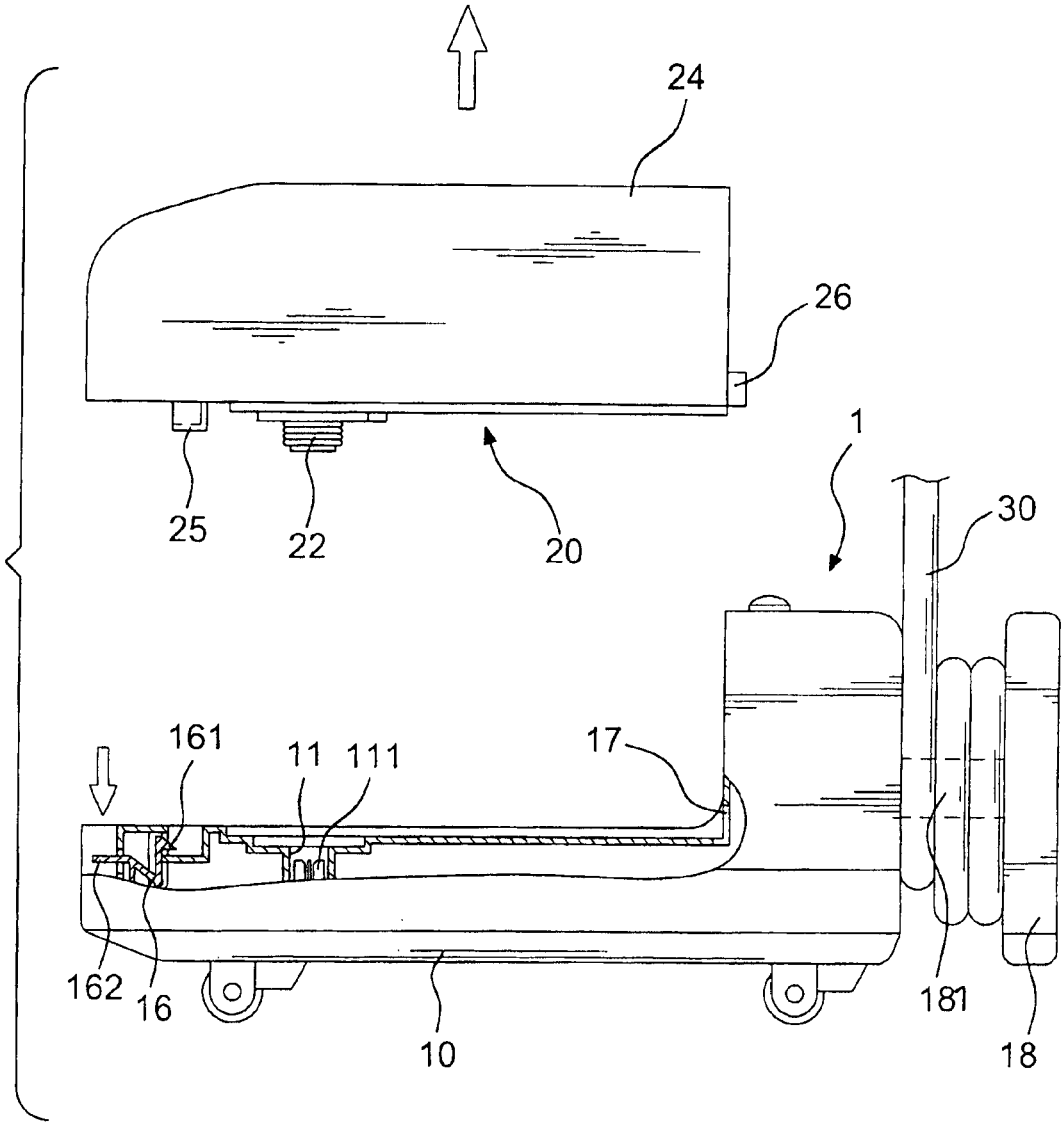
FIG. 3 is an exploded side plan view showing the detachment of the reservoir from the mainframe.

The mainframe (10) has a hole (11) defined in a hollow body of the mainframe (10) and having multiple extension rods (111) formed on a peripheral side wall defining the hole (11), a recess (13) defined in the hollow body to receive therein a filter (12) which has an inlet (121) in communication with the hole (11) and an outlet (122), a control pump (14) sandwiched between the telescopic tube and the outlet (122) of the filter (12) for pumping water toward the nozzle assembly (40), a master switch (15) electrically connected to the control pump (14) to control the actuation of the control pump (14) and a baffle (18) securely connected to a rear portion of the hollow body by a neck (181) (as shown in FIG. 3).

A locking device in accordance with the preferred embodiment includes a spring-driven hooking member (16) with a hook (161) formed on a front portion of the hooking member (16) and a press (162) formed on a rear portion and extending out of the hooking member (16). The hooking member (16) is received in an indentation (100) defined in the hollow body of the mainframe (10). Multiple cutouts (17) are defined in a joint between a wall extending upright from the hollow body and a top face of the hollow body. An engaging member (19) is formed on the wall and has an engaging hook (191) and a knob (192) to control the movement of the engaging hook (191). More details concerning the interaction between the engaging hook (191) and the knob (192) will be discussed in the follow.

Figure 2:
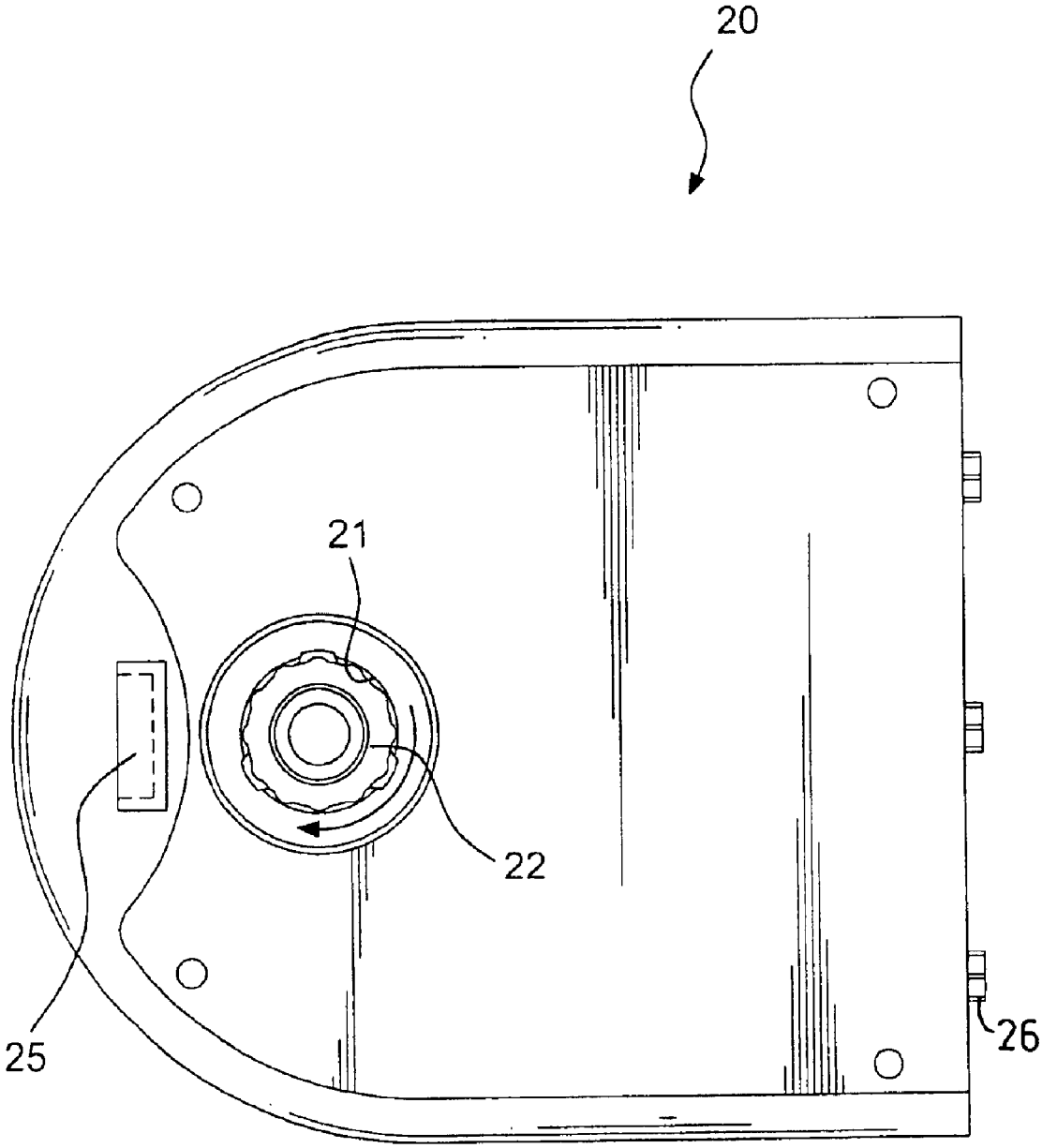
FIG. 2 is a bottom plan view of the reservoir of the preferred embodiment.

With reference to FIGS. 2 and 3, the locking device further has an L-shaped plate (25) formed on a bottom face of the reservoir (20) to correspond to the hook (161) of the hooking member (16) and engaging plates (26) formed on a bottom rear side of the reservoir (20) to correspond to the cutouts (17) of the mainframe (10).

It is appreciated that the reservoir (20) is hollow inside so that the reservoir (20) can be filled with water. Accordingly, the reservoir (20) has an exit (21) defined in the bottom face of the reservoir (20) to correspond to the hole (11) of the mainframe (10) and a unidirectional valve (22) mounted inside the exit (21) to correspond to the extension rods (111) in the hole (11). Besides, due to the provision of the neck (181) and the baffle (18), the telescopic tube (30) can be mounted around the neck (181) to save space of the vapor cleaner as an entirety.

Figure 4:
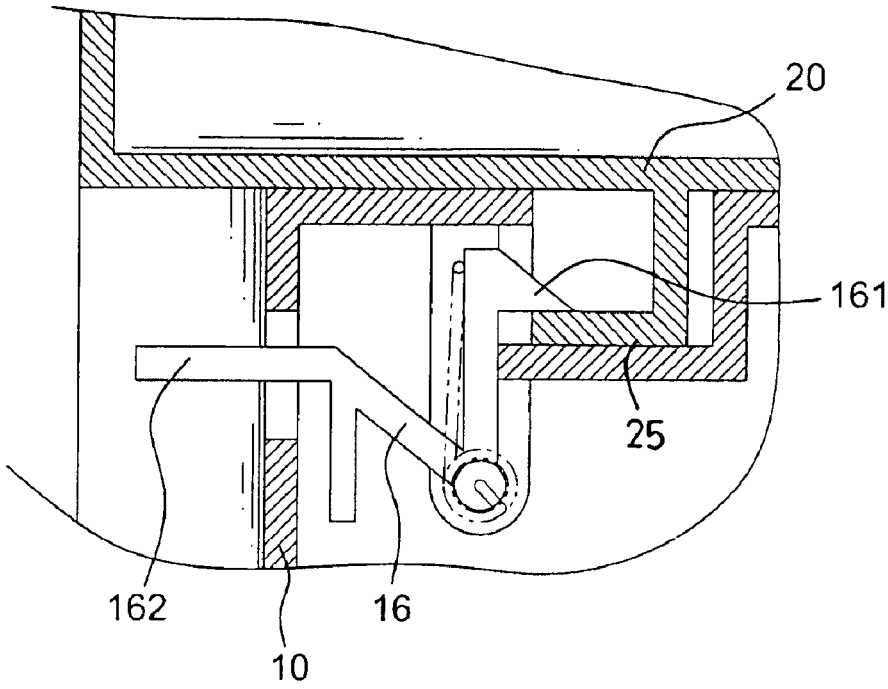
FIG. 4 is an enlarged schematic view with partial in cross section to show the engagement of the locking device to the reservoir.

When the reservoir (20) is to be mounted on top of the mainframe (10), with reference to FIG. 4, the L-shaped plate (25) is inserted beneath the hook (161) and then the engaging plates (26) are inserted into the corresponding cutouts (17) so that the reservoir (20) is securely engaged with the mainframe (10). Meanwhile, the extension rods (111) in the hole (11) of the mainframe (10) activate the unidirectional valve (22) to communicate the hollow body of the mainframe (10) with the hollow reservoir (20). Thereafter, the water received in the hollow reservoir (20) is able to flow to the filter (12) and the telescopic tube (30).

Referring to FIG. 1, the nozzle assembly (40) in accordance with the preferred embodiment has a handle (41) formed on top of the nozzle assembly (40), a nozzle (42) formed on a front portion of the nozzle assembly (40), a locking plate (43) formed on a bottom face of the nozzle assembly (40), a heater (45) received in the nozzle assembly (40) and electrically connected to the master switch (15) of the mainframe (10), a control switch (46) mounted on the handle (41) to control the exit of vapor due to the heating effect to the water flowing through the heater (45) and out of the nozzle (42) and an indicator (47) formed adjacent to the control switch (46) to indicate status of the heater (45).

Furthermore, a casing (24) is provided on top of the reservoir (20) by screws and has a positioning ledge (241) formed on a centrally defined through hole (240) in the casing (24).

Figure 6:
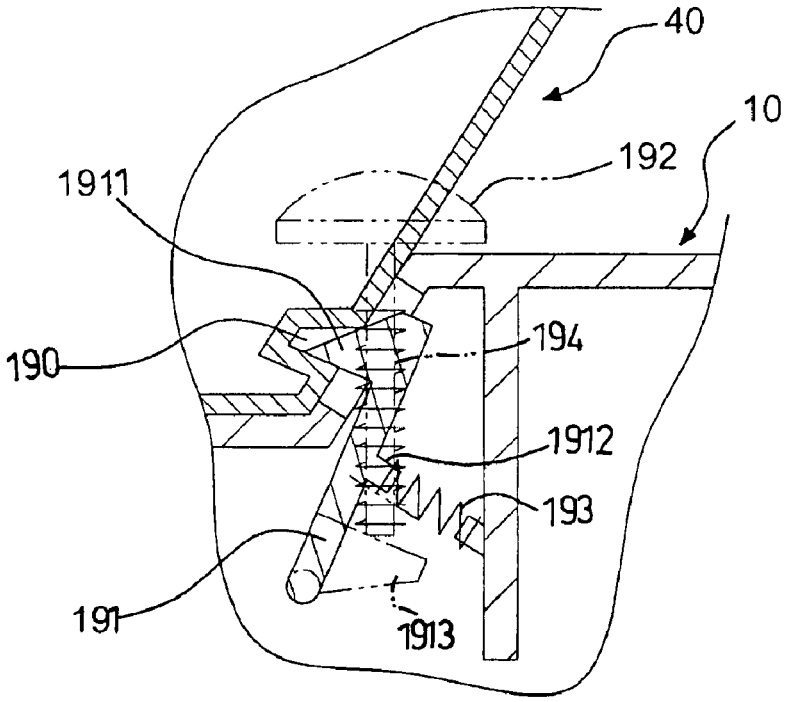
FIG. 6 is a schematic cross sectional view showing the linking relationship between the locking device and the nozzle assembly.
Figure 5:
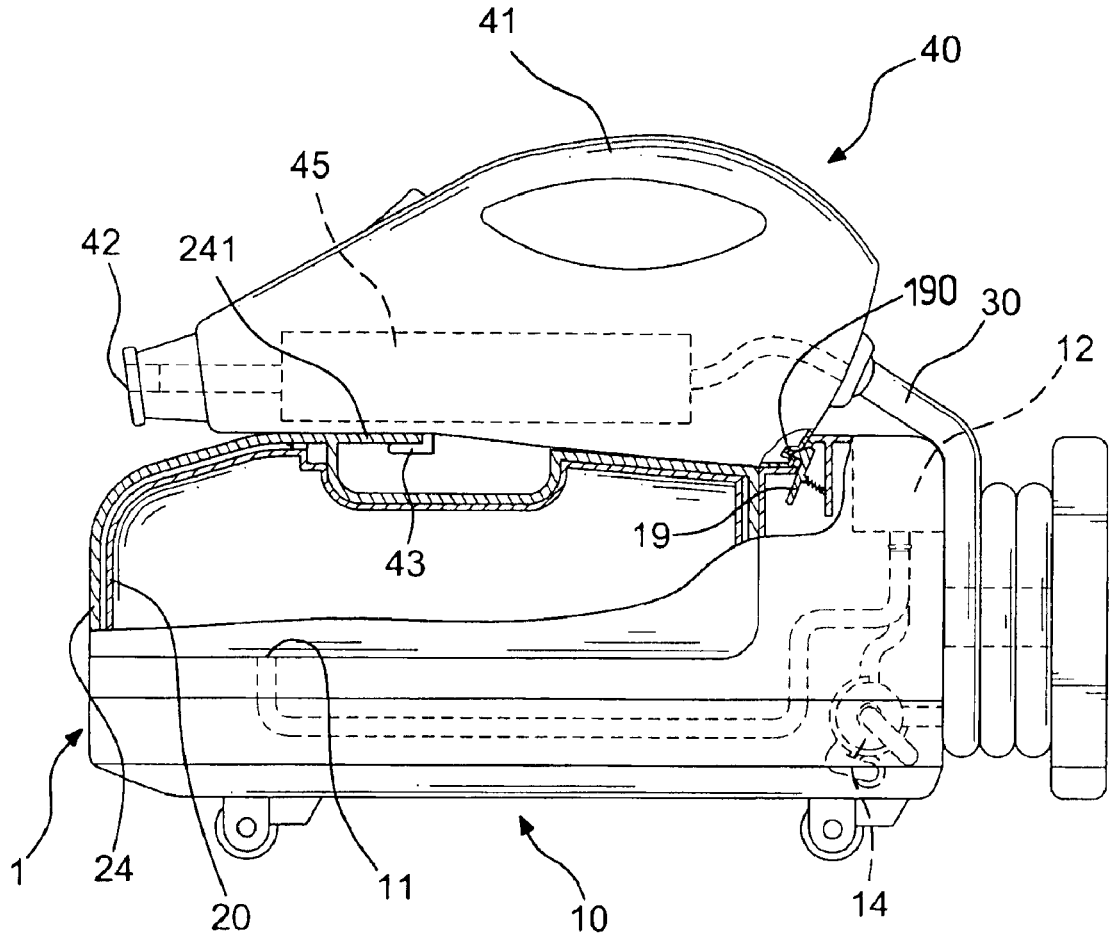
FIG. 5 is a schematic side plan view with partial in cross section to show the engagement between the nozzle assembly and the mainframe.
Figure 7:
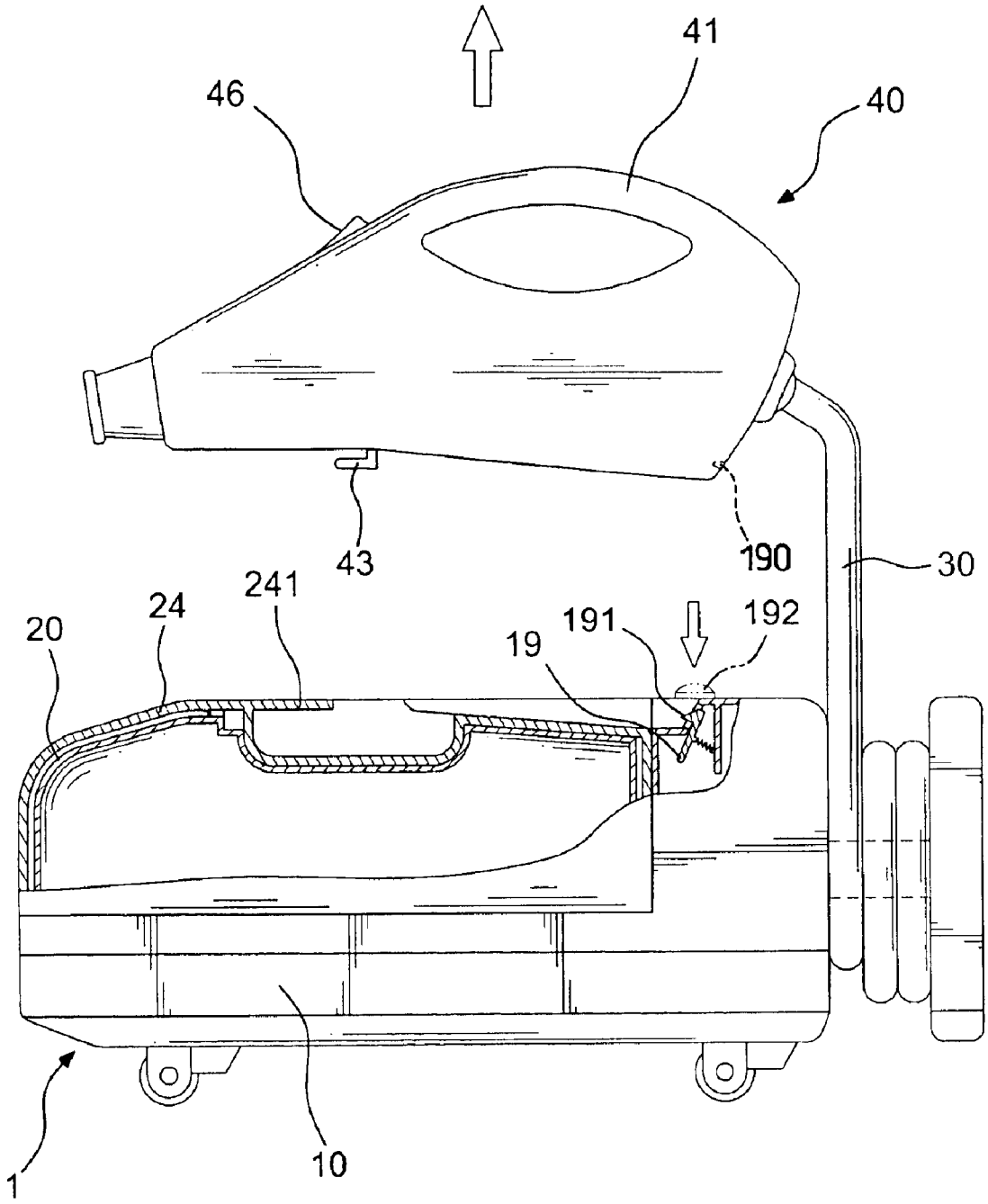
FIG. 7 is a schematic side plan view showing the detachment of the nozzle assembly to the mainframe.

With reference to FIGS. 5, 6 and 7, when the nozzle assembly (40) is to be mounted on the mainframe (10) with the casing (24) mounted on top of the reservoir (20), a positioning device is provided to secure engagement between the nozzle assembly (40) and the mainframe (10). The positioning device has a positioning recess (190) defined in a rear portion of the nozzle assembly (40), a pivot (191) pivotally received in and extending out from a side face of the wall and having a locking head (1911) formed on a first distal end of the pivot (191), an extension (1912) formed on a mediate portion of the pivot (191) and a block (1913) formed on a second distal end of the pivot (191) and a control knob (192) movably received in the wall of the mainframe (10) to engage with the block (1913). A first spring (193) is provided between a side wall of the mainframe (10) and the extension (1912) to provide a recovery force to the pivot (191) and a second spring (194) is mounted around the control knob (192) to provide a recovery force to the control knob (192). Therefore, when the nozzle assembly (40) is to be mounted on top of the mainframe (10), the locking plate (43) formed on the bottom of the nozzle assembly (40) is inserted under the positioning ledge (241) and then the locking head (1911) is inserted into the positioning recess (190) in the rear portion of the nozzle assembly (40). Thus the nozzle assembly (40) is secured to the mainframe (10). When the nozzle assembly (40) is to be detached from the mainframe (10), the operator presses the control knob (192). Due to the engagement of the distal end of the control knob (192) to the block (1913), the downward movement of the control knob (192) is able to activate the pivotal movement of the pivot (191), which releases the limitation of the locking head (1911) to the positioning recess (190) of the nozzle assembly (40). Thereafter the nozzle assembly (40) is free from engagement with the mainframe (10) and the operator is able to move the nozzle assembly (40) as desired.

Furthermore, when the master switch (15) is activated, the pump (14) starts pumping water from the reservoir (20) which communicates with the hollow body of the mainframe (10) to allow water in the reservoir (20) to first flow through the filter (12). Pollutant in the water is filtered out by the filter (12) and then the water flows through the telescopic tube (30) and into the heater (45). Because the heater (45) is already heated after the master switch (15) is on, water flowing through the heater (45) is transformed into vapor. Therefore, if the control witch (46) is pressed, the vapor is able to exit from the nozzle (42).

Because the nozzle assembly (40) is detachably connected to the mainframe (10), the operator is able to hold the nozzle assembly (40) easily and move around as required.

Furthermore, because of the detachability of the reservoir (20) from the mainframe (10), the water refill to the reservoir (20) becomes easy and effortless.

Figure 8:
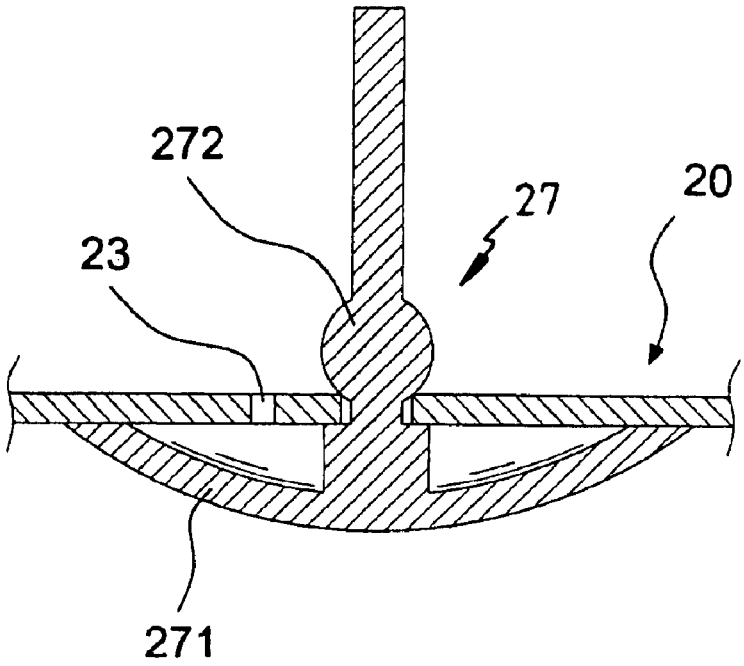
FIG. 8 is a schematic cross sectional view showing the relationship between the stop and the ventilation hole in the reservoir.
Figure 9:
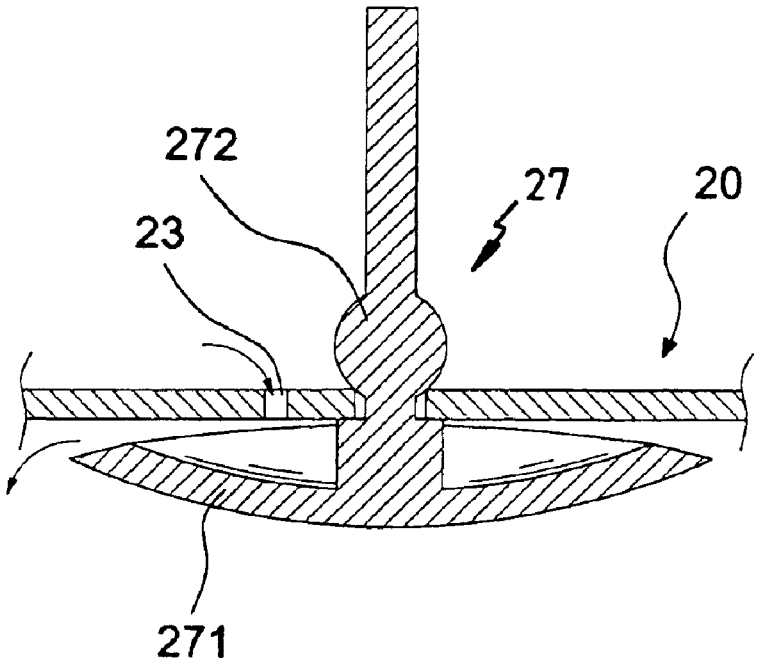
FIG. 9 is a schematic cross sectional view showing that the stop leaves the ventilation hole to allow pressure equilibrium inside and outside the reservoir.

With reference to FIGS. 8 and 9, it is noted that a controlling element (27) is inserted in the ventilation hole (23) of the reservoir (20). The controlling element (27) has a membrane (271) formed outside the ventilation hole (23) and a sphere (272) received in the ventilation hole (23). Therefore, when the reservoir (20) is filled with water with the reservoir (20) up side down (due to the hole being defined in the bottom of the reservoir (20)), the membrane (271) allows air to flow into the reservoir (20) to reach pressure equilibrium inside and outside the reservoir (20). When the reservoir (20) is filled with water and the reservoir (20) is stood upright for use, the membrane (271) stops water from leaking out of the reservoir (20).

Figure 10:
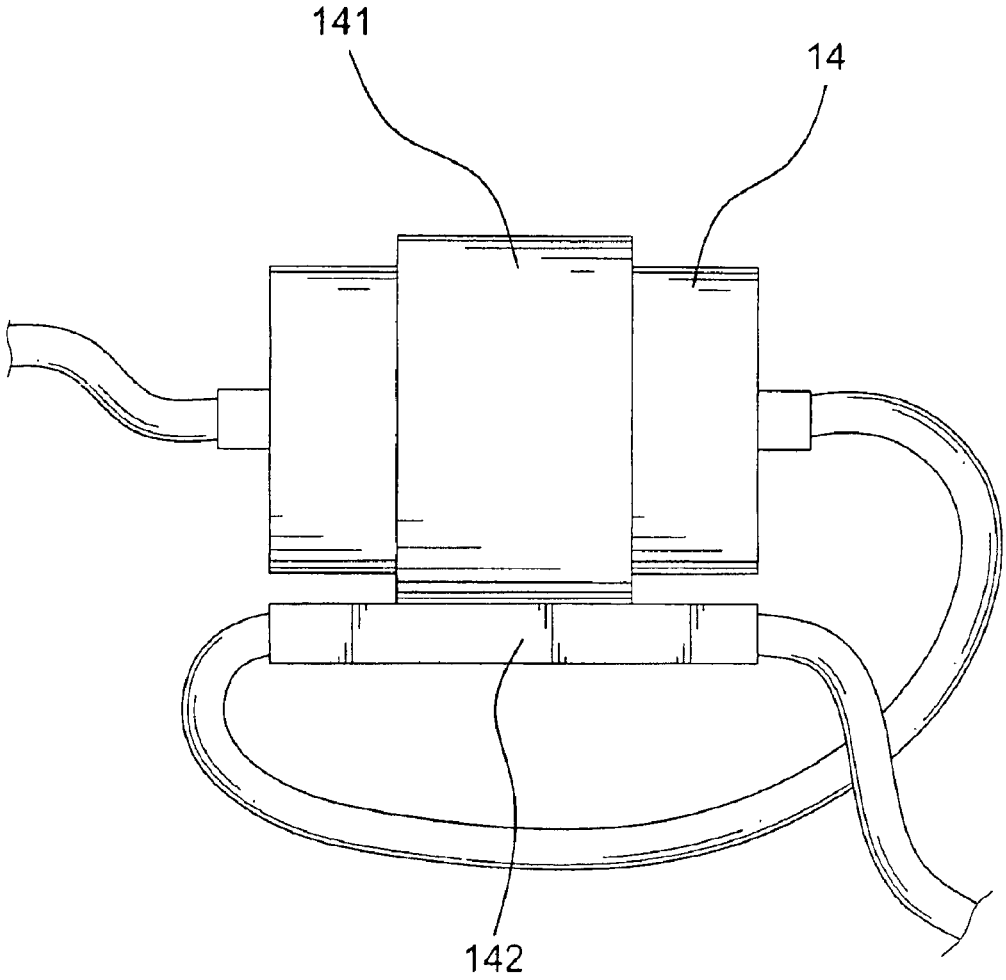
FIG. 10 is a schematic side plan view showing that the control pump has a heat dissipating plate attached to the outer periphery of the control pump to facilitate heat dissipation of the control pump.

With reference to FIG. 10, it is noted that the control pump (14) has a heat dissipating plate (141) mounted around the control pump (14) to facilitate heat dissipation from the control pump (14) and a metal tube (142) integrally formed with the heat dissipating plate (141) and mounted around the inlet (121) of the filter (12) to transmit heat from the control pump (14) to heat the water flowing through the inlet (121) of the filter (12). Therefore, not only the water is heated, but also the life span of the control pump (14) is prolonged due to the heat dissipating plate to dissipate the heat generated by the control pump (14).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vapor cleaner comprising:

a mainframe having a hole defined in a hollow body of the mainframe, a recess defined in the hollow body to receive therein a filter with an inlet in communication with the hole and an outlet in communication with a telescopic tube;

a control pump sandwiched between the outlet of the filter and the telescopic tube for pumping water to the telescopic tube;

a nozzle assembly detachably connected to the mainframe and having a heater received in the nozzle assembly for heating the water pumped by the control pump to flow through the heater from the telescopic tube; and a reservoir detachably connected to the mainframe via a locking device which comprises:

a spring driven hooking member received in an indentation in the hollow body and having a hook formed on a front portion of the hooking member and a press formed on a rear portion and extending out of the hooking member, multiple cutouts defined in the hollow body;

an L-shaped plate formed on a front portion of a bottom of the reservoir to correspond to the hook of the hooking member; and multiple engaging plates formed on a side face of the reservoir to correspond to the cutouts of the hollow body of the mainframe.

2. The vapor cleaner as claimed in claim 1, wherein the mainframe further has a casing mounted on top of the reservoir to encase the reservoir and having a centrally defined through hole and a positioning ledge formed on a periphery of the through hole of the casing.

3. The vapor cleaner as claimed in claim 2, wherein the nozzle assembly is detachably connected to a combination of the casing and the reservoir via a positioning device provided to secure engagement between the nozzle assembly and the mainframe and comprising:

a positioning recess defined in a rear portion of the nozzle assembly;

a pivot pivotally received in and extending out from a side face of the wall and having a locking head formed on a first distal end of the pivot;

an extension formed on a mediate portion of the pivot and a block formed on a second distal end of the pivot and a control knob movably received in the wall of the mainframe to engage with the block, wherein a first spring is provided between a side wall of the mainframe and the extension to provide a recovery force to the pivot and a second spring is mounted around the control knob to provide a recovery force to the control knob such that when the nozzle assembly is to be mounted on top of the mainframe, the locking plate formed on the bottom of the nozzle assembly is inserted under the positioning ledge and then the locking head is inserted into the positioning recess in the rear portion of the nozzle assembly, whereby the nozzle assembly is secured to the mainframe.

4. The vapor cleaner as claimed in claim 1, wherein the reservoir has an exit corresponding to the hole of the mainframe and a unidirectional valve mounted inside the exit to correspond to extension rods formed on an inner periphery defining the hole such that when the reservoir is mounted on the mainframe, the unidirectional valve is activated by the extension rods of the mainframe.

5. The vapor cleaner as claimed in claim 2, wherein the reservoir has an exit corresponding to the hole of the mainframe and a unidirectional valve mounted inside the exit to correspond to extension rods formed on an inner periphery defining the hole such that when the reservoir is mounted on the mainframe, the unidirectional valve is activated by the extension rods of the mainframe.

6. The vapor cleaner as claimed in claim 3, wherein the reservoir has an exit corresponding to the hole of the mainframe and a unidirectional valve mounted inside the exit to correspond to extension rods formed on an inner periphery defining the hole such that when the reservoir is mounted on the mainframe, the unidirectional valve is activated by the extension rods of the mainframe.

7. The vapor cleaner as claimed in claim 1 further comprising a baffle securely connected to a rear portion of the mainframe by a neck such that the telescopic tube is able to be mounted around the neck to save space.

8. The vapor cleaner as claimed in claim 3 further comprising a baffle securely connected to a rear portion of the mainframe by a neck such that the telescopic tube is able to be mounted around the neck to save space.

9. The vapor cleaner as claimed in claim 4 further comprising a baffle securely connected to a rear portion of the mainframe by a neck such that the telescopic tube is able to be mounted around the neck to save space.

10. The vapor cleaner as claimed in claim 5 further comprising a baffle securely connected to a rear portion of the mainframe by a neck such that the telescopic tube is able to be mounted around the neck to save space.

* * * * *